United States Patent [19]

Manqvist et al.

[11] Patent Number: 5,070,654

[45] Date of Patent: Dec. 10, 1991

[54] SELF-CENTERING ARRANGEMENT FOR GRINDING THE HARDMETAL PINS OF DRILL BITS

[75] Inventors: Kallevi K. Manqvist, Gothenburg, Sweden; Robert Sjolander, Oakville, Canada

[73] Assignee: C.M.E. Blasting & Mining Equipment, Ltd., Gothenburg, Sweden

[21] Appl. No.: 422,128

[22] Filed: Oct. 16, 1989

[30] Foreign Application Priority Data

Oct. 17, 1988 [SE] Sweden ..... 8803684

[51] Int. Cl.[5] ..... B24B 3/33

[52] U.S. Cl. ..... 51/120; 51/125.5; 51/119; 51/170 MT; 51/266; 409/200

[58] Field of Search ..... 51/170 MT, 171, 126, 51/125.5, 125, 124 C, 120, 119, 124 R, 123 R, 116, 117, 118, 109 R, 99, 106 CG, 35, 73, 266; 409/199, 200

[56] References Cited

U.S. PATENT DOCUMENTS

| | | | |
|---|---|---|---|
| 3,036,409 | 5/1962 | Whitcomb | 51/99 |
| 3,641,709 | 2/1972 | Gazuit | 51/99 |
| 3,854,250 | 12/1974 | Vornberger | 51/99 |
| 4,123,877 | 11/1978 | Pere | 51/99 |
| 4,419,846 | 12/1983 | Schimitzeh | 51/55 |
| 4,555,229 | 11/1985 | Beady's | 51/55 |
| 4,858,388 | 8/1989 | Bice | 51/125.5 |

FOREIGN PATENT DOCUMENTS

| | | |
|---|---|---|
| 81069783 | 7/1984 | Sweden . |
| 87029500 | 1/1988 | Sweden . |
| 86041597 | 4/1988 | Sweden . |

*Primary Examiner*—D. S. Meislin
*Assistant Examiner*—Blynn Shideler
*Attorney, Agent, or Firm*—Volpe and Koenig

[57] ABSTRACT

An arrangement for grinding the hardmetal pins of drill bits, e.g. the tungsten carbide buttons (31) of button bits (1), comprises means (parallel arms pairs 9 and 10) for adjusting the position of a grinding pin (15) in relation to the drill bit (1) and also journalling means (4) operative to cause the grinding machine (3) to move relatively slowly in a circuit path around the button on the drill bit (1) to be ground and to cause the grinding pin (15) to rotate rapidly around its longitudinal axis. The drill bit is clamped securely in a stationary holder arrangement (2) which includes a tiltable table (35) which can be adjusted to and locked in selected angular positions.

9 Claims, 5 Drawing Sheets

26
23
4
22
27
28
24
25
29
3
15
30

SELF-CENTERING ARRANGEMENT FOR GRINDING THE HARDMETAL PINS OF DRILL BITS

TECHNICAL FIELD

The present invention relates to a self-centering grinding arrangement for grinding the hardmetal pins or working tips of drill bits and more specifically, but not exclusively, for grinding the tungsten carbide buttons of button bits of the kind used, e.g., for drilling wells or like down-the-hole drilling operations in the mining industry. The arrangement includes a stationary holder arrangement in which the drill bits are clamped and which accommodates a liquid-coolant collecting vessel. The arrangement also includes a grinding machine equipped with a grinding pin which rotates about its longitudinal axis, and a grinding machine journalling device which extends at an angle to the longitudinal axis of said pin. The journalling device functions to impart rotary motion to the grinder, with the center of rotation lying in the center of the grinding pin.

BACKGROUND ART

Examples of self-centering grinding arrangements intended for grinding the tungsten carbide buttons of button bits of the aforesaid kind are described in Swedish Patent Application No. 8604159-7. The grinding pin of these known grinders executes two distinct forms of movement, i.e. the pin rotates about its own longitudinal axis and also carries out a superposed circuitous or orbital movement. The grinding machine and its drive means are mounted on a column-carried jib arm which can be raised and lowered, up and down the column. The bit to be ground is clamped in a fixture or jig which can be moved freely on an electromagnetic table, when the table is not magnetic. Initially, the fixture in which the bit is clamped is brought into approximate alignment with the grinding machine, whereafter the jib arm is lowered, so as to bring the grinding pin into engagement with the carbide button of the bit to be ground. Since, at this stage, the fixture is able to move freely on the table, it is said that the carbide button will center itself in relation to the grinding pin. Subsequent hereto, the table is brought to its magnetic state, such as to lock the fixture in position on the table.

This known grinding arrangement thus includes a holder arrangement which can be moved in the horizontal plane. A similar grinding arrangement is described and illustrated in Swedish Patent Application No. 8702950-0, in which the bit holder arrangement includes a carriage which runs on a platform and which can be raised and lowered relative to the grinding machine. The grinding machine is attached to the top of a stand or frame and is mounted for limited vertical movement therein.

Such known grinding arrangements, however, do not permit bits to be ground in a rational manner, since only one bit can be clamped in the holder at any one time. It is also doubtful that effective self-centering of the button actually takes place, since the holder and the load carried thereby, i.e. the bit, constitute a heavy and relatively sluggish unit which has to be acted upon by the grinding pin itself, in order to center on the pin. Another problem which is not solved satisfactorily by the known grinders is one of controlling the force at which the grinding pin is intended to bear against each individual button on the bit. In the case of known grinder constructions, it would appear that this problem is solved through the intermediary of the weight exerted by the grinding machine and its journalling devices.

SUMMARY OF THE INVENTION

All of the aforesaid problems are solved by the inventive self-centering grinding arrangement, in that the grinding machine journalling device is moveable both horizontally and vertically in relation to the bit holder, which is stationarily mounted. The grinding machine journalling device is carried on pairs of mutually parallel arms which are journalled for rotation on a vertically extending stand or frame structure and which co-act with pneumatic piston-cylinder devices. The cylinder infeed pressure can be switched to a grinding pressure mode, in which grinding pressure acts vertically during a grinding operation, and a compensating, auxiliary pressure mode for facilitating manual movement of the grinding machine.

The inventive grinding arrangement enables the grinding pin setting to be readily adjusted manually, due to the fact that the weight of the grinding machine is counteracted by the compensating functions of the piston-cylinder devices, i.e. the aforesaid auxiliary pressure mode. A self-centering effect, or fine adjustment of the grinding pin setting, is achieved automatically, by switching the cylinder input pressure to the grinding pressure mode. Due to the full freedom of movement of the inventive grinding machine journalling device in all space planes, it is possible to grind a multiple of drill bits in a rational manner. For instance, the stationary bit holder arrangement can be provided with two bit holders for a corresponding number of bits. The grinding machine journalling device can be swung to a position in which it is located above respective holders, or above a drill bit which, because of its dimensions, has been located outside the holder arrangement, and the cylinder input pressure then switched to its grinding pressure mode.

The holders provided in the holder arrangement preferably have the form of recesses located in at least one tiltable table which is capable of being stopped and locked in desired angular positions and which has mounted beneath its upper surface, i.e. the table top, a pneumatically operated piston rod for each holder. A well-defined location of the drill bit in respective holders can be achieved by providing each recess with a corner piece and by directing piston movement towards said corner piece, the stem of the bit being inserted into the recess and clamped against the corner piece by means of the activated piston rod. In order to enable drill bits of widely varying dimensions to be held firmly in respective bit holders, the tiltable table is provided with a bottom plate which can be displaced positionally beneath the recess, such as to allow smaller drill bits having relatively short stems to rest against the plate.

Although two separate tiltable tables, each provided with two drill-bit holders, can be served by one and the same journalling device, an advantageous and preferred embodiment is one in which each table is provided with an individual journalling device and therewith with an individual grinding machine. This embodiment greatly rationalises the handling of drill bits to be ground, since two bits can be ground simultaneously, while the operator is able to remove a ground bit from one table and insert in the adjacent holder a fresh bit to be ground, in respective tables.

The holder arrangement and associated collecting vessel are constructed so as to function as a transport container for transportation of the grinding arrangement in its dismantled state, the grinding arrangement components being accommodated in the transport container.

DESCRIPTION OF PREFERRED EMBODIMENTS

Figure 1:
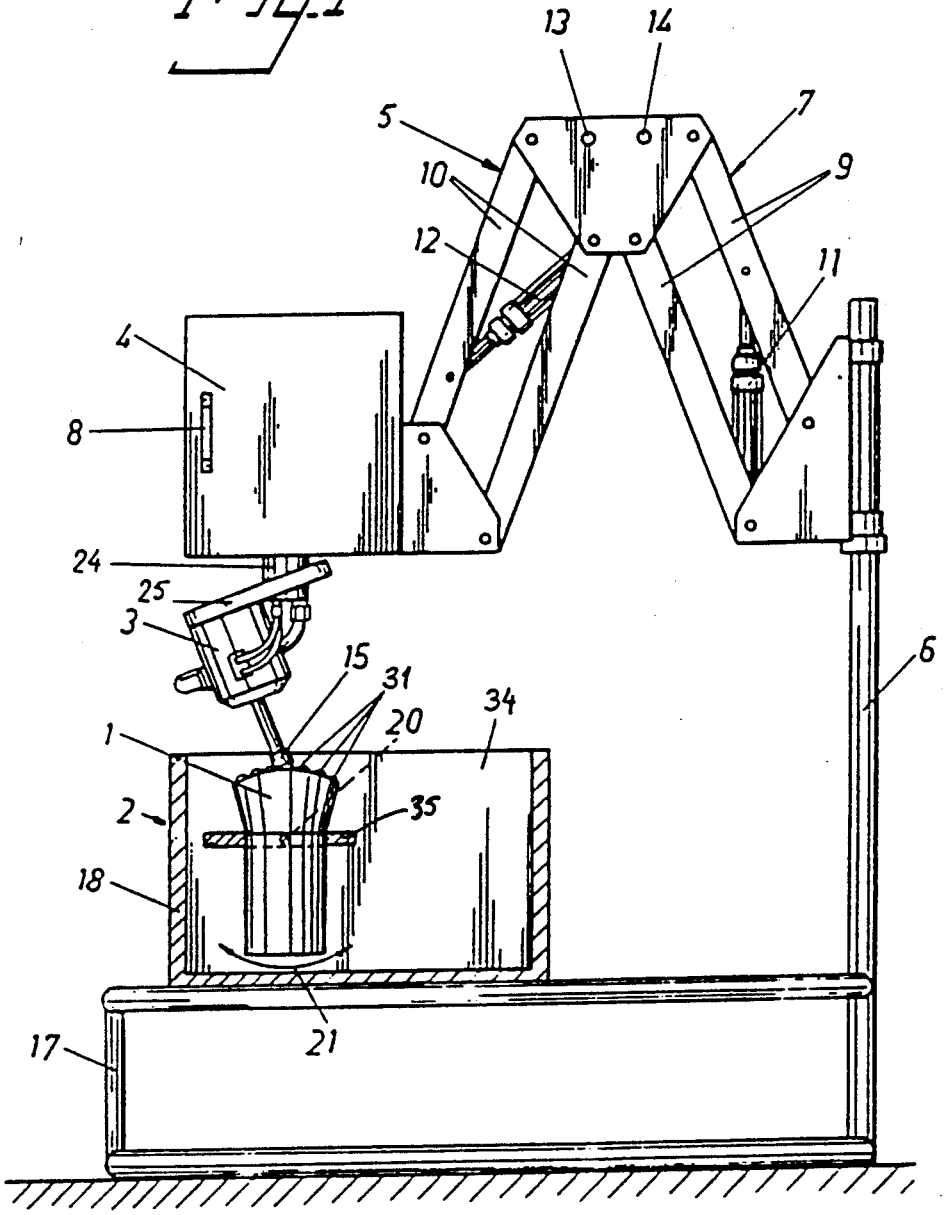
Figure 2:
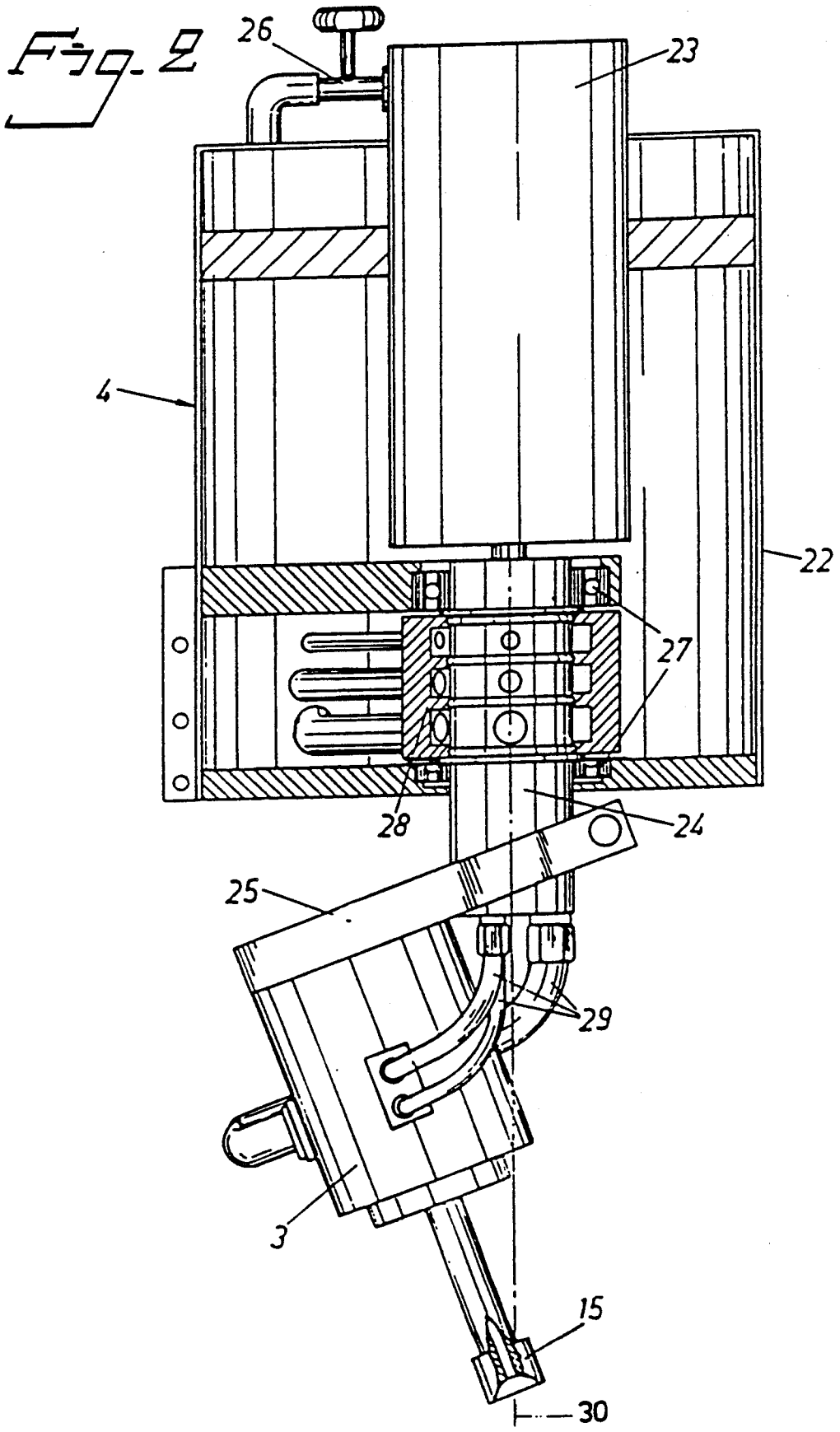
Figure 3A:
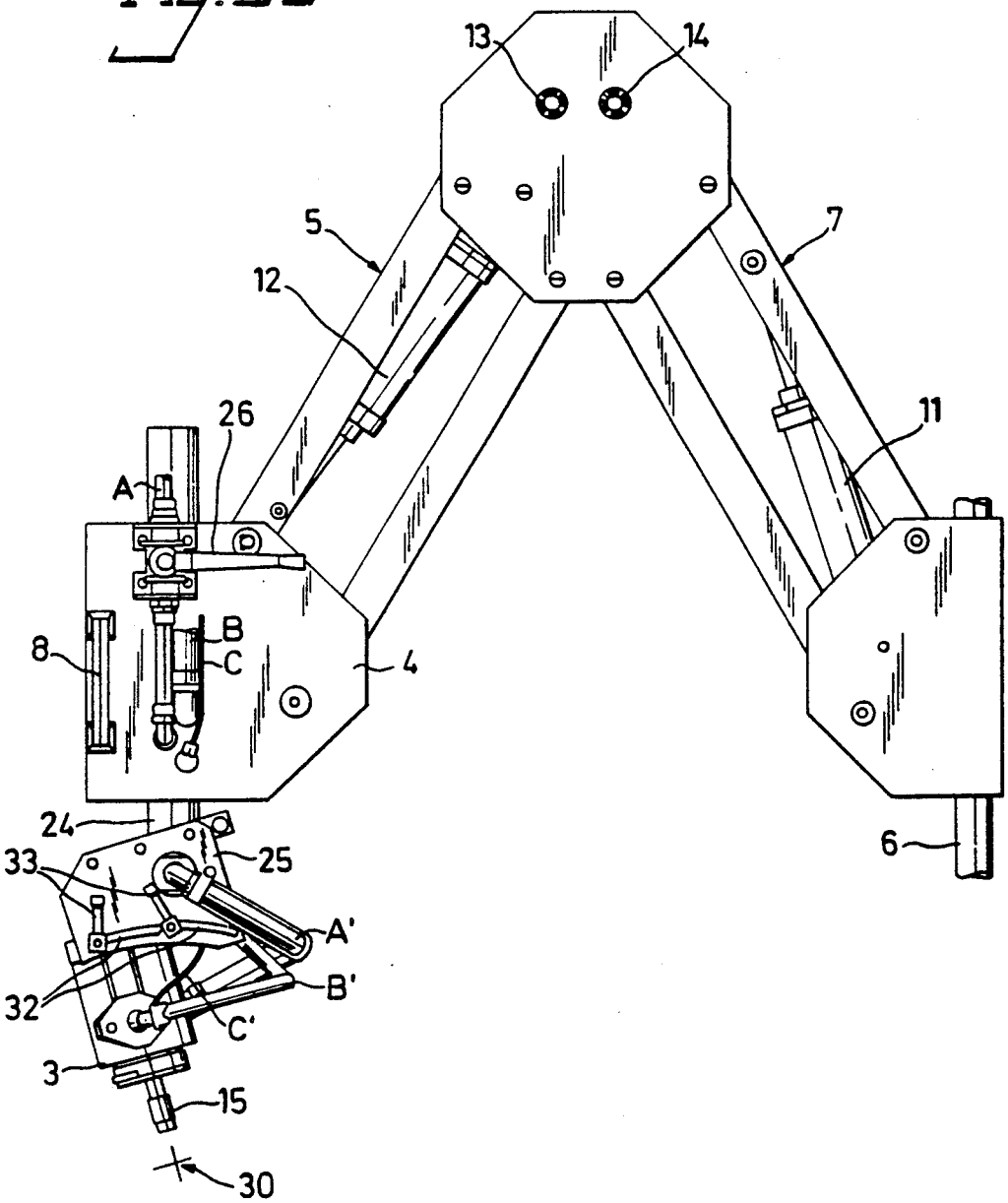
Figure 3B:
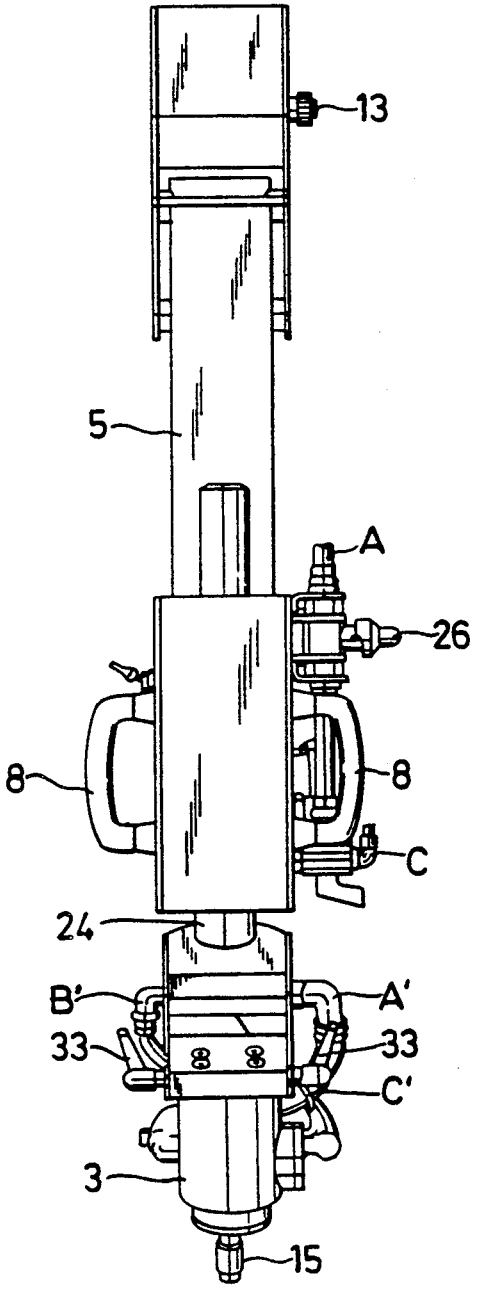
Figure 4:
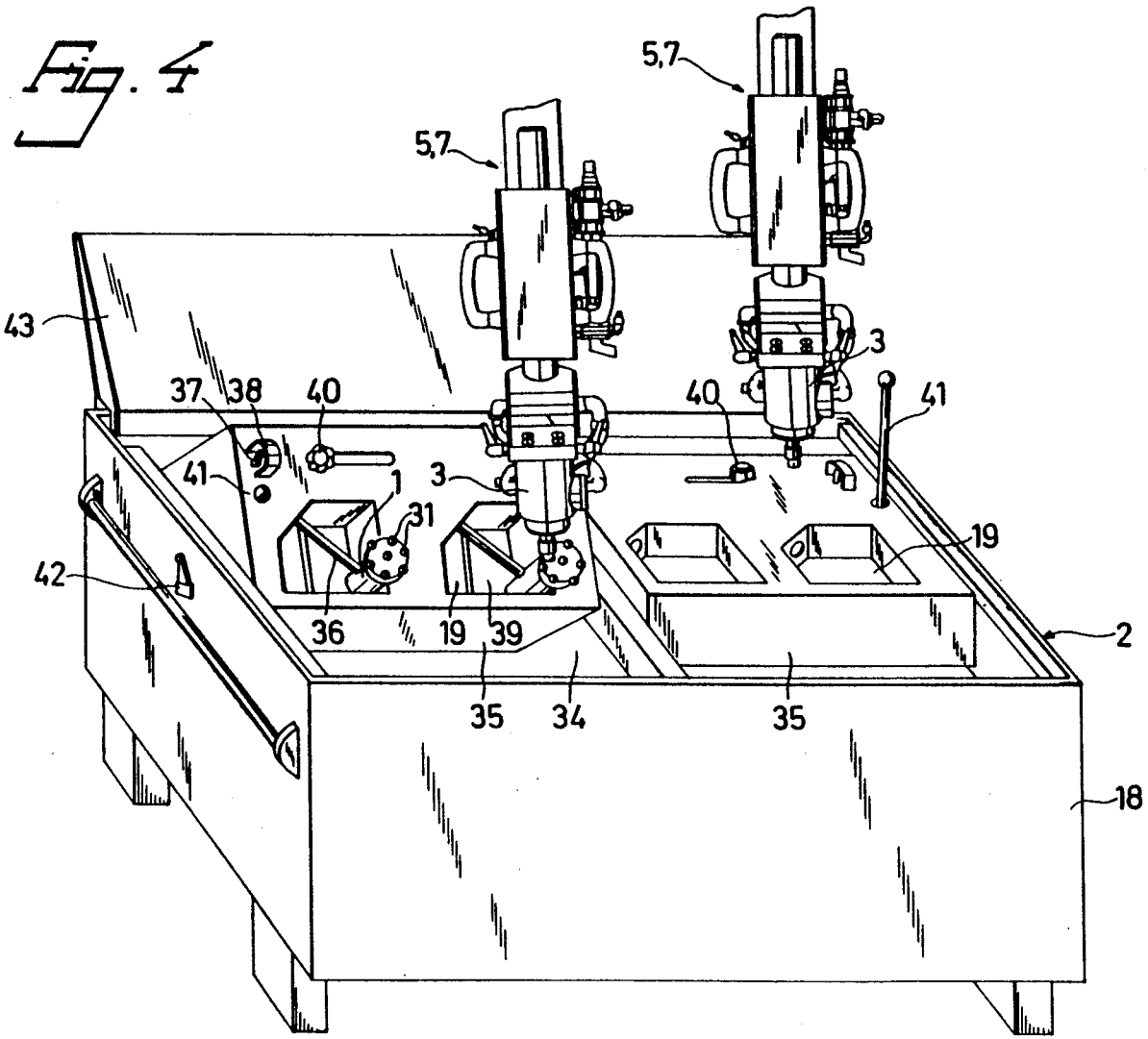

The self-centering grinding arrangement according to the present invention will now be described in more detail with reference to a preferred embodiment thereof and with reference to the accompanying drawings, in which FIG. 1 is a side view illustrating the principle construction of an inventive grinding arrangement;

FIG. 2 is a sectional view of the journalling device operative in imparting orbital movement to the grinding machine;

FIGS. *3a–b* illustrate a preferred embodiment of the inventive grinding arrangement; and FIG. 4 is a perspective view of a preferred embodiment of a multi-bit holder arrangement.

FIG. 1 illustrates the principle construction of a grinding arrangement according to the present invention. The grinding arrangement comprises a bit holding arrangement for those bits whose tungsten carbide buttons 31 are to be ground. The arrangement also includes a journalling device 4 which is intended to carry a grinding machine 3. The grinding machine 3 includes a drive motor which rotates a grinding pin 15 at high speed about its longitudinal axis. The journalling device also includes a further drive motor which has a shaft 24 on which the grinding machine 3 can be adjustably mounted, by means of an attachment means 25. The drive motor of the journalling device 4 is operative to impart circuitous or orbital movement to the grinding machine 3 and its grinding pin 15, with the center of rotation in the grinding center 30 of the grinding pin 15 (FIG. 2).

The journalling device is carried by parallel arm pairs 5, 7 which are journalled on a post or column 6 for rotation through an angle of 360°. The post 6 is mounted on a floor frame 17.

Each of the parallel arm pairs 5, 7 includes an inner and an outer arm pair 9 and 10 respectively, such that the journalling device 4 and the grinding machine carried thereby can be moved freely, both vertically and horizontally, within the span of the parallel arm pairs 5, 7. The grinding pin 15 is brought manually into alignment with the tungsten carbide button to be ground, by gripping a handle 8 and moving the grinding pin 15 to a position immediately above the button 31. This manual movement is facilitated by a double-acting, pneumatic compensating piston-cylinder device 11, 12 provided between the pivotal arms within respective arm pairs 9, 10. When pressure is fed to the pneumatic piston-cylinder-devices 11, 12, the pistons exert a compensating force on the parallel arm pairs 5, 7, such that the journalling device 4 will remain stationary in the position to which it was adjusted manually by the operator. An adjustable pressure regulator 13 is included in the supply circuits of respective piston-cylinder devices 11, 12, for the purpose of achieving a correct balancing effect.

The supply circuits of the piston-cylinder-devices also include a switch 14 which is operative to switch the direction of air supply, such as to cause the parallel arm pairs 5, 7 to exert a vertical downward force on the journalling device 4 and the grinding machine 3. This facility is utilised for the automatic, continuous grinding operation described herebelow.

FIG. 2 illustrates the principle construction of the journalling device 4. The main components of this device include a housing 22, which houses the further drive motor 23 and its output shaft 24. The drive motor is supplied with air under pressure from the same conduit as that used to supply air under pressure to the grinding machine 3. Arranged in the branch leading to the drive motor 23 is a throttle valve 26, by means of which the operator can regulate the flow of air to the further drive motor 23 and control the speed of said motor from zero to maximum values.

The output shaft 24 is journalled in the housing 22 on two ball bearings 27 and has provided therein three passageways which are supplied with air to and from the grinding machine 3 and with cooling water to said machine, via a swivel switch 28. The passageways are connected to the grinding machine 3 by hoses 29.

The grinding machine attachment 25 is attached to the lower end of the output shaft 24 at a given angle which is so adapted that the grinding center 30 of the grinding pin 15 will coincide with the rotational axis of the output shaft 24, despite the fact that the grinding machine is angularly positioned. As a result hereof, the drive motor 23 will drive the grinding machine 3 in a circuit path during a grinding operation, therewith providing a highly satisfactory grinding result. As mentioned above with reference to FIG. 1, the attachment 25 can be adjusted to mutually different angular positions for adaptation to the angular position of the drill bit to be ground.

FIGS. *3a* and *3b* illustrate a preferred embodiment of the inventive grinding arrangement. The arrangement is shown in side view in FIG. *3a* and in front view in FIG. *3b*. The majority of the reference numerals used in FIGS. *3a* and *3b* are found in FIG. 1 and identify mutually corresponding components of the two embodiments.

In the case of the illustrated and described preferred embodiments, the journalling device 4 suspended from the parallel arm pairs 5, 7 includes supply devices for air supply A, B and cooling water supply C, each said supply device being connected, via the swivel switch or coupling, to the grinding machine by a respective pivotal pipe A', B', C', these pipes corresponding to the hoses 29 of the FIG. 1 embodiment. The conduit A incorporates the throttle valve 26 referred to with reference to FIG. 2.

FIGS. *3a* and *3b* ilustrate more clearly the preferred embodiment of the adjustable attachment means 25. This attachment means includes a casing which has formed therein two arcuate grooves or channels for coaction with locking pins and locking devices 33 associated therewith, thereby enabling the position of the grinding machine to be fixated relative to the journalling device 4. The angle subtended between the longitudinal axis of the grinding pin 15 and the longitudinal axis of the drive shaft 24 can therefore be controlled, which is desirable for effective control of the amplitude of the orbital or circuitous movement before mentioned.

FIG. 4 illustrates a preferred embodiment of a drill-bit holder arrangement 2 intended for holding the drill bits whose tungsten carbide buttons 31 are to be ground. The holder arrangement comprises a box 18 having an upwardly facing opening 34 in which one or more tables 35 are pivotably mounted, as indicated by the axle 20 and the arrow 21 in FIG. 1. Each table 35 includes two or more holders 19 in the form of substantially rectangular recesses, into which the stem of the drill bit 1 is inserted. The holder 19 also includes a pneumatic piston-cylinder device whose piston 36 functions to hold the drill bit 1 locked effectively against the walls of said recesses. The piston-cylinder device of respective holders 19 is preferably arranged such that the piston of each said device will operate in the direction of one diagonal of the recesses, therewith to lock the drill bit 1 effectively against one corner of the recesses, as will be seen from the table 35 shown to the left in FIG. 4.

The piston-cylinder devices of the holders 19 are operated by means of a valve 37, which is housed in a casing 38 in order to shield the valve against unintentional activation. Consequently, the operator can only activate the valve 37 from the mutually opposite open sides. When activated from one side, the valve 37 will operate to impart locking movement to the piston cylinder-device, and when activated from the other side will impart a release movement to said device.

As will be seen from FIG. 4, the holder 19 is provided with a displaceable floor 39, which enables the holder to accommodate drills of small dimensions in a ready manner. The floor 39 is displaced with the aid of a lever 40. In the FIG. 4 illustration, the floor 39 of the left-hand table 35 is shown to be displaced to a position in which it will support drill bits 1 of small dimensions. The floor 39 of the right-hand table of the illustration has been moved away, so as to enable drill bits 1 of large dimensions to be fitted, the head diameters of these bits being so large as to allow the heads to rest on the surface of the floor 39, when the drill stem is inserted into one of the holder recessess of the table.

As mentioned above, each table can be adjusted to a desired angular position. This adjustment is facilitated by means of a lever 41, which can be pulled or drawn up in the manner shown at the right-hand table in FIG. 4. The table can be locked in its selected position, by means of a locking device 42.

The box 18 serves as a collecting vessel for the liquid coolant delivered to the grinding location from the grinding machine during a grinding process. Detachable splash guards 43, of which only one is shown in FIG. 4, can be fitted to all side walls of the box 18. The box 18 is connected to a circulation pump and filter arrangement, for recycling the liquid coolant to the grinding machine 3.

A further advantage afforded by the box 18 is that the box is adapted to accommodate the whole of the grinding arrangement. Subsequent to being dismantled to a given extent, the grinding arrangement can be packed into the box 18, which then serves as a transportation crate. It is indicated in FIG. 4 that the illustrated preferred embodiment of the holder arrangement 2, comprising two tables 35 which can be manouvered independently of one another, can be assigned two grinding machines 3, each journalled in parallel arm pairs 5, 7. This enables drill bits of mutually different dimensions to be ground separately at one and the same time. By providing each table with two holders 19, the possibility is afforded of switching bits in one of the holders while grinding a bit in the other.

Naturally, it lies within the purview of the invention to fit the box 18 with only one tiltable table 35 and also to use only one grinding machine 3 with each box 18.

When the inventive grinding arrangement is to be brought into use and is transported to its place of use in the box or crate 18, the various components are removed from the box and assembled together, whereafter liquid coolant is introduced into the grinding arrangement and the arrangement is connected to suitable compressed air sources. The grinding arrangement is now ready for use.

The drill bits 1 whose tungsten carbide buttons 31 are to be ground are clamped in respective holders 19 on the tables 35. The tables are then inclined to positions for grinding the buttons located on the crown or periphery of respective bits. The grinding pin 15 of the grinding machine 3 is then moved forwards to the first button 31 to be ground. During this adjusting movement of the grinding pin 15, compressed air is supplied to the compensating piston-cylinder devices 11, 12 of the parallel arm pairs 5, 7, so as to enable the operator to bring the grinding pin 15 manually into position, centrally above the button 31, in a ready and easy fashion. Subsequent to bringing the grinding pin into alignment with the button 31, the operator manipulates the switch 14, so as to switch the supply of compressed air from the compensating piston-cylinder devices 11, 12 to the grinding pressure facility, while starting the drive motors 3 and 23 at the same time. The grinding pin 15 will automatically find its correct grinding position on the tungsten carbide button 31, through a self-centering action, and grinding is commenced.

As the drill bit is being ground, the operator is able to exchange ground bits for fresh, worn bits in a holder located adjacent the holder containing the bit being ground. Subsequent hereto, there remains nothing else for the operator to do, other than to switch off the grinding arrangement when grinding of said bit is completed. Upon completion of this working operation, the switch 14 is turned to its compensating position and the grinding pin 15 is moved manually to a fresh button to be ground. The aforesaid automatic self-centering action and subsequent grinding procedure are then repeated.

When the drill bits to be ground have large dimensions, such that the drill stems are too large for the holders 19, the parallel arm pairs can be rotated on the post 6 to a position externally of the box 18. The drill bits of excessively large dimensions can be clamped in this position with the aid of suitable means and the tungsten carbide buttons thereof ground with the aid of the same machine used to grind the drill bits of smaller dimensions.

In those instances when the button of a drill bit to be ground is excessively worn and it is consequently necessary to grind down material located around the button, there is used a grinding pin which is particularly intended for this purpose. This particular grinding pin requires the grinding machine to be held firm in one and the same position. Such locking of the grinding machine can be achieved readily with the inventive construction, by closing the throttle valve 26 and therewith stopping rotation of the rotating journalling device 4.

All types of rock drilling equipment, i.e. drills of different profiles and different sizes, etc., can be ground with the aid of the inventive grinding machine, and the invention is not therefore restricted to button bits provided with tungsten carbide buttons.

It will also be understood that the invention is not limited to the described and illustrated embodiments thereof and that modifications and changes are possible within the scope of the following claims. For example, the drill bit holder can be configured in a manner which will tailor the holder to a drill bit of particular manufacture. Furthermore, the arrangement may include a pump system operative to pump liquid coolant from the collecting vessel 18 back to the grinding machine 3.

We claim:

1. A self-centering arrangement for grinding the hardmetal pins of drill bits of the kind used within the mining industry for drilling wells and like down-the-hole drilling operations, in which the drill bits (1) are clamped in a holder arrangement (2) including a liquid coolant collecting vessel (18) and which grinding arrangement includes a grinding machine (3) equipped with a grinding pin (15) driven by motor (23) to rotate about its longitudinal axis and further includes a grinding machine journalling device (4) which is positioned at an angle to the longitudinal axis of said grinding pin (15) and which is operative to allow the grinding machine (3) to move in an orbital path with the center of rotation lying in the grinding center of the grinding pin (15), characterized in that the grinding machine journalling device (4) is moveable in the horizontal and the vertical plane relative to the holder arrangement (2), which is stationary; and in that the journalling device is mounted on parallel arm pairs (5, 7) pivotally mounted on a vertical stand (6) said parallel arm pairs (5, 7) comprise an inner and an outer arm pair (9 and 10 respectively) which are pivotally connected together; in that the arm pairs (9, 10) coact with a piston-cylinder device (11, 12) acting on one pivot arm of said arm pair; in that the inner arm pair (9) is carried by the vertical stand (6) and the outer arm pair (10) is carried by the grinding machine journalling device (4); and in that the route of the supply pressure to the piston-cylinder-devices can be switched by means of a valve switch (14) to provide a vertically acting grinding pressure during an automatic grinding operation and to provide a compensating auxiliary pressure during normal manual movement of the grinding machine.

2. An arrangement according to claim 1, characterised in that the stationary holder arrangement (2) includes at least one tiltable table (35) having at least two holders (19) for a corresponding number of drill bits (1); in that the said at least one tiltable table (35) can be locked in a desired angular position for grinding both axially directed tungsten carbide buttons (31) on the drill bit (1) and buttons which are directed at an angle to the axis of said bit.

3. An arrangement according to claim 2, characterised in that the stationary holder arrangement (2) includes two separate tiltable tables (35) each of which includes two holders (19); and in that each table is assigned one journalling device (4) and an associated grinding machine (3).

4. An arrangement according to claim 1, characterised in that the grinding machine journalling device (4) includes a housing which is mounted on the free end of the outer arm pair (10) of said parallel arm pairs and which houses a drive motor (23) for effecting said orbital movement, said motor (23) having a shaft direction which, by means of the parallel arm pairs (5, 7), is held parallel with the vertical stand (6) carrying the inner arm pair (9) of said parallel arm pairs, and in that the grinding machine is attached to the shaft (24) of the drive motor by means of an attachment (25) which can be locked in mutually different positions, therewith obtaining said angular position between the longitudinal axis of the grinding pin (15) and the grinding machine journalling device (4).

5. An arrangement according to claim 4, characterised in that the attachment (25) includes a casing in which there is formed at least one arcuate groove (32) in which a locking pin (33) extending from the grinding machine (3) protrudes such as to fixate the grinding machine in a desired angular position relative to the shaft (24) of the drive motor.

6. An arrangement according to claim 5, characterised in that each of the holders (19) of the table (35) has the form of a recess provided in the table top and fitted with a corner piece against which the stem of a drill bit (1) inserted in the recess is held clamped by means of a piston-cylinder-device (36) located beneath the top of the table (35).

7. An arrangement according to claim 6, characterised in that each recess (12) in the table top has an area sufficiently large to accommodate drill bits (1) of a broad dimensional range; and in that the table (35) has mounted therein a bottom plate (39) which can be displaced in said recess and which functions to support the short stems of drill bits (1) of smaller dimensions.

8. An arrangement according to claim 4, characterised in that the drive motor shaft (24) is configured with a plurality of passageways intended for supplying air and cooling liquid to hoses (A, B, C) provided on the grinding machine, via swivel couplings (28).

9. An arrangement according to claim 2, characterised in that the vertical stand includes a tubular post on which the inner arm pair (9) is mounted for pivotal movement in a horizontal direction; and in that the outer arm pair can be moved manually between different drill bits (1) in the stationary drill bit holder arrangement (2) and also to drill bits clamped outside the stationary holder arrangement.

* * * * *

UNITED STATES PATENT AND TRADEMARK OFFICE

CERTIFICATE OF CORRECTION

PATENT NO. : 5,070,654

DATED : December 10, 1991

INVENTOR(S) : Manqvist et al.

It is certified that error appears in the above-identified patent and that said Letters Patent is hereby corrected as shown below:

IN THE CLAIMS

In claim 9, column 8, line 44, delete "2" and insert therefor --1--.

Signed and Sealed this

Sixth Day of April, 1993

*Attest:*

STEPHEN G. KUNIN

*Attesting Officer*

*Acting Commissioner of Patents and Trademarks*